United States Patent [19]

Asano

[11] 4,352,169

[45] Sep. 28, 1982

[54] ELECTRONIC TIMEPIECE

[75] Inventor: Kazuhiro Asano, Tokyo, Japan

[73] Assignee: Kabushiki Kaisha Daini Seikosha, Japan

[21] Appl. No.: 933,094

[22] Filed: Aug. 11, 1978

[30] Foreign Application Priority Data

Sep. 1, 1977 [JP] Japan ..... 52-105079

[51] Int. Cl.[3] ..... G04B 23/02; G04C 3/00; G08B 3/00

[52] U.S. Cl. ..... 368/73; 368/204; 368/250; 340/384 E

[58] Field of Search ..... 58/38 R, 38 A, 39, 23 A, 58/23 BA, 19 R, 57.5, 23 C, 50 R; 340/384 E; 368/72–75, 250, 255, 203–204; 307/264; 323/16, 17

[56] References Cited

U.S. PATENT DOCUMENTS

| | | | |
|---|---|---|---|
| 3,886,924 | 6/1975 | Kamya | 58/23 BA |
| 3,975,896 | 8/1976 | Kasama | 58/23 BA |
| 3,979,899 | 9/1976 | Yoshida et al. | 58/4 A |
| 4,023,050 | 5/1977 | Fox et al. | 307/264 |
| 4,029,973 | 6/1977 | Kobayashi et al. | 307/264 |
| 4,044,546 | 8/1977 | Koike | 58/50 R |
| 4,045,691 | 8/1977 | Asano | 307/264 |
| 4,061,929 | 12/1977 | Asano | 307/246 |
| 4,068,461 | 1/1978 | Fassett et al. | 58/38 R |
| 4,098,071 | 7/1978 | Kawakami et al. | 58/39 R |
| 4,104,628 | 3/1978 | Sweany et al. | 340/384 E |
| 4,104,865 | 8/1978 | Sasaki | 58/58 |
| 4,123,671 | 10/1978 | Aihara et al. | 307/270 |
| 4,124,806 | 11/1978 | Rusznyak | 307/264 |
| 4,145,872 | 3/1979 | Portmann | 307/264 X |

*Primary Examiner*—Vit W. Miska

*Attorney, Agent, or Firm*—Robert E. Burns; Emmanuel J. Lobato; Bruce L. Adams

[57] ABSTRACT

An electronic timepiece having a liquid crystal display device and a buzzer comprised of a piezoelectric element. A voltage booster circuit comprised of a capacitor and a semiconductor switching element boosts the voltage of the voltage supply, and the boosted voltage is applied to drive the liquid crystal display device. A buzzer driving circuit inverts the booster voltage and simultaneously applies the booster voltage and the inverted booster voltage to drive the piezoelectric buzzer element. The operating frequency of the voltage booster is increased when the buzzer is operated and when the booster voltage and inverted booster voltage are applied to energize the piezoelectric buzzer element.

5 Claims, 5 Drawing Figures

ELECTRONIC TIMEPIECE

BACKGROUND OF THE INVENTION

The present invention relates to an alarm electronic timepiece using a piezoelectric element as a buzzer.

Conventionally, because of the high driving voltage, around 10 V, a coil was necessary to drive the piezoelectric element of a buzzer.

FIG. 1 shows an embodiment of the conventional driving circuit.

As for the conventional method, however, the reduction of the price and miniaturization of the electronic timepiece could not have been realized satisfactory because of the high price of the coil and the large space occupied thereby.

While as for a liquid crystal display type electronic timepiece, a booster circuit for driving a liquid crystal consists of a capacitor and switching elements were provided besides the coil mentioned above, and therefore the composition of the liquid crystal display type electronic timepiece was uneconomical since a couple of booster circuits were required in one timepiece.

The object of the present invention is to provide an alarm electronic timepiece of low price and small size by overcoming the above mentioned disadvantages, and particularly, to achieve the above mentioned object by driving the buzzer using the booster circuit used for a liquid crystal display.

DESCRIPTION OF THE PREFERRED EMBODIMENT

Hereafter, the present invention will be described in conjunction with the accompanying drawings.

Figure 1:
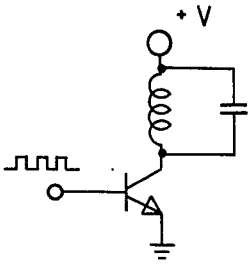
FIG. 1 (PRIOR ART)
FIG. 1 is a conventional buzzer driving circuit.
Figure 2:
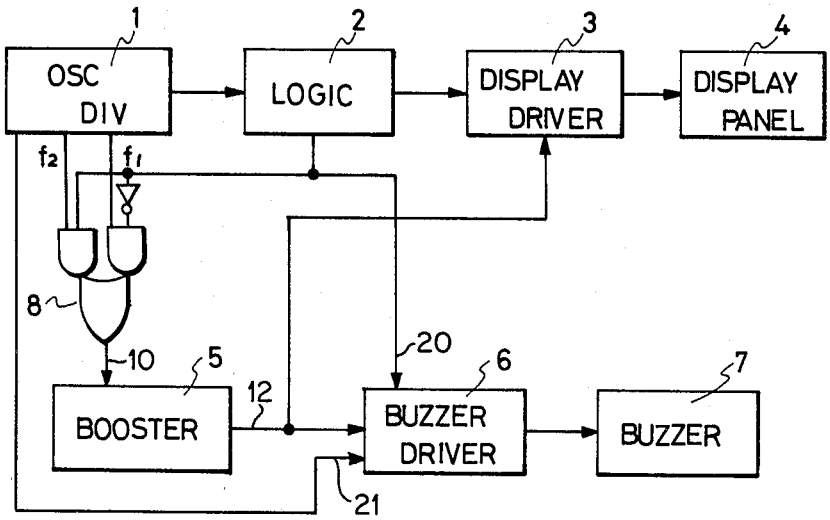
FIG. 2 is a block diagram of an electronic timepiece according to the present invention.

FIG. 2 shows a block diagram of the electronic timepiece according to the present invention, wherein numeral 1 is a time reference signal oscillation dividing portion (refer to as a dividing portion hereafter), and the outputs thereof are respectively connected to a logical operation portion 2 and an AND·OR selective gate 8.

The outputs from the logical operation portion 2 are respectively connected to the AND·OR selective gate 8, a buzzer driving circuit 6 and a display driving circuit 3, and the display driving circuit 3 receives the output from a booster circuit 5 to thereby drive a display panel 4.

The buzzer driving circuit 6 receives the output from the booster circuit 5 and drives a buzzer 7.

The operation of the electronic timepiece of the above described structure is as follows.

When the buzzer is not driven, a clock signal $f_1$ of comparatively low frequency is selected from the dividing portion 1 by the buzzer control signal from the logical operation portion 2 and fed to the booster circuit 5 through the AND·OR gate 8. Accordingly, the output current which the booster circuit can supply is comparatively small, i.e. to the extent the display driving portion 3 and the display panel 4 can be driven.

On the other hand, when the buzzer is driven, the outputs from the logical operation portion 2 invert and a clock signal $f_2$ of comparatively high frequency is fed to the booster circuit 5 through the AND·OR gate 8.

The output current which the booster circuit 5 can supply increases greatly since the driving clock signals become large and thereby the display driving portion 3, the display panel 4, the buzzer driving portion 6 and the like can be driven sufficiently.

Figure 3:
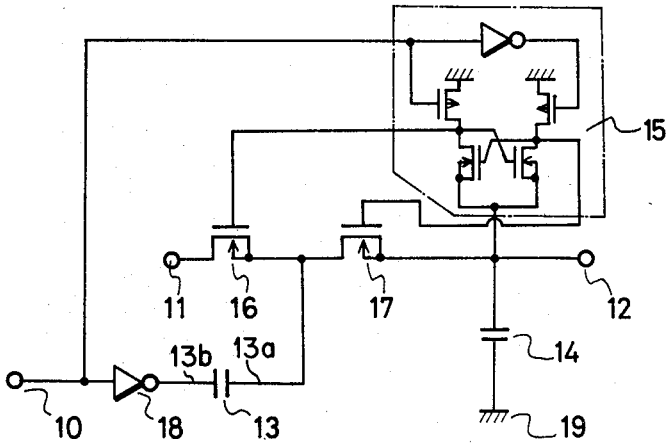
FIG. 3 is an embodiment of the booster circuit according to the present invention.

FIG. 3 illustrates the circuit structure of the voltage booster circuit 5. Earth or ground 19 defines a reference potential of zero volts, and the positive potential of a power supply is connected to ground. The negative potential $-E/2$ of the power supply is connected to terminal 11. In operation a clock signal is applied to the clock signal input terminal 10 of the booster circuit 5. The clock signal may be supplied from a stage of the dividing portion 1 of the timepiece circuit.

In response to the clock signal having a "low" logic level (or simply "L") the output of the inverter becomes "high" (or simply "H"), i.e. the inverter 18 output signal level becomes zero volts. At the same time the N channel field effect transistor 16 becomes conductive (or simply "ON") and the N channel field effect transistor 17 becomes non-conductive (or simply "OFF"), so that the potential level of the terminal 13*a* of the capacitor 13 becomes $-E/2$. Transistors 16 and 17 are semiconductor switches. When the clock signal input terminal 10 subsequently receives a "H" signal level the output of the inverter 18 becomes "L", i.e. $-E/2$. At the same time the level shift circuit 15 turns the N channel field effect transistor 16 "OFF" and turns the N channel field effect transistor 17 "ON". Thus, the level shift circuit 15 operates as means for alternately rendering opposite ones of the semiconductor switches 16, 17 conductive and non-conductive in synchronism with the selected signal applied by the signal selecting gate circuit 8 to the voltage booster circuit. Consequently, the potential of the capacitor terminal 13*b* becomes $-E/2$ and the potential of the capacitor terminal 13*a* becomes $-E$. Therefore, the capacitor 14 develops a potential of $-E$, which is applied to the capacitor 14 by the capacitor 13. In this manner, the booster circuit 5 generates an output voltage twice as great as the power supply voltage by using the clock signal. The operation of FIG. 3 is not illustrated as it is already known.

Figure 4:
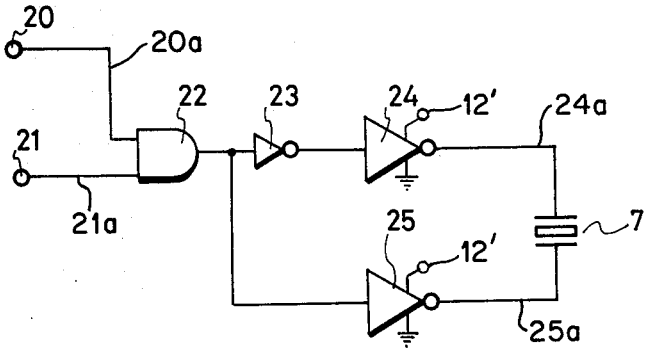
FIG. 4 is an embodiment of the driving circuit according to the present invention.

FIG. 4 shows an embodiment of the buzzer driving circuit, wherein a terminal 20 is a control signal input terminal for receiving an output signal from the logical operation portion 2, a terminal 21 is a sound clock signal input terminal from the dividing portion 1, and both terminals 20 and 21 are respectively connected to the input of an AND gate 22. The output from the AND gate 22 is connected to the respective inputs of an inverter 25 for driving and an inverter 23 for phase inversion, and the output from the inverter 23 is connected to the input of an inverter 24 for driving. The inverters 23, 24 and 25 are powered by the output voltage $-E$ from the booster circuit 5. The booster circuit output voltage $-E$ developed at output terminal 12 is applied to the power terminals 12' of the inverters 24 and 25. The inverter output signals thus can exhibit a voltage swing equal to E and they therefore operate as amplifiers.

The outputs from the inverters 24 and 25 for driving are respectively connected to an electrode of the buzzer 7.

The operation of the driving circuit of the above described structure will be illustrated as follows.

When the control signal from the logical operation circuit 2 is "L", the AND gate 22 prohibits the clock signal applied to the other input from being applied to the inverters, and thereby a fixed voltage equal to the supply voltage (the output voltage of the booster circuit 5) is applied to the buzzer 7.

The buzzer 7 does not buzz under the described condition.

When the signal from the terminal 20 changes to "H", the AND gate 22 passes the clock signals from the terminal 21, and signals in phase with the clock signals are produced from the inverter 24 for driving and the signals of 180 degrees out of phase with the clock signals are produced from the inverter 25 for driving. Accordingly, the buzzer is driven with both positive and negative signals of the same amplitude, i.e. the output signals of the inverters 25 and 26, respectively.

Figure 5:
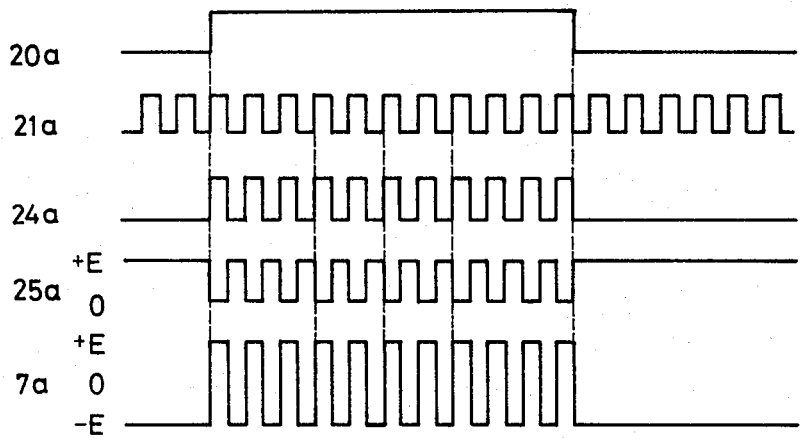
FIG. 5 is a chart of waveforms of signals developed in various portions of the driving circuit.

FIG. 5 shows a time chart of signal waveforms developed in various portions of the driving circuit.

As illustrated, according to the present invention, the booster circuit of the type usually used to drive the display also drives the buzzer by making the clock frequency higher, further, the buzzer is driven with the amplitude twice that of the signal output voltage of the booster by driving two sides of the buzzer with opposite polarity signals, and thereby the electronic timepiece provided with a buzzer is realized without adding components.

Furthermore, the coil which was expensive and which occupied a large space of the timepiece, which was conventionally necessary, becomes unnecessary and thereby the present invention contributes to make the timepiece small size and to reduce the cost thereof.

I claim:

1. An electronic timepiece, comprising: an oscillator circuit for generating a plurality of oscillatory output signals; means comprising a logic circuit for generating a buzzer control signal to control buzzer operation and for generating output signals representative of time; display means responsive to the output signals of said logic circuit for displaying time; a buzzer comprised of a piezoelectric element; a buzzer driving circuit for applying an oscillatory driving signal to drive said piezoelectric element; a voltage booster circuit comprising voltage boosting means for boosting a supply voltage applied to said voltage boosting means and for applying an oscillatory driving signal having an amplitude equal to the boosted voltage to said buzzer driving circuit, and said voltage boosting means having an output current capacity dependent upon the frequency of an oscillatory input signal applied thereto; signal selection means responsive to said buzzer control signal for selecting among different frequency oscillatory output signals generated by said oscillator circuit and for applying a selected signal of one frequency to said voltage booster circuit when said buzzer is to be inoperative and for applying another selected signal of a different frequency to said voltage booster circuit when said buzzer is to operate and which is effective to increase the output current capacity of said voltage booster circuit during buzzer operation.

2. An electronic timepiece according to claim 1, wherein said voltage boosting means has an output current capacity that increases in response to an increase in the frequency of the input signal applied thereto; and wherein said signal selection means is effective for selecting and applying a lower frequency signal when said buzzer is to be inoperative and for selecting and applying a higher frequency signal when said buzzer is to be operative in order to increase the output current capacity of said voltage booster circuit during buzzer operation.

3. An electronic timepiece according to claim 1 or 2, wherein said voltage booster circuit is comprised of: a first circuit branch comprising the series combination of a supply voltage input terminal, a first semiconductor switch, a second semiconductor switch, and a grounded capacitor; a second circuit branch comprising the series combination of an input terminal for receiving the selected signal selected by said signal selection means, an inverter circuit, and a second capacitor connected between an output terminal of said inverter circuit and the node defined by the connection between said first and said second semiconductor switches; means for alternately rendering opposite ones of said semiconductor switches conductive and non-conductive in synchronism with the selected signal applied to said voltage booster circuit so as to charge said first and said second capacitors to a voltage level twice that of the supply voltage applied to said supply voltage input terminal; and the node defined by the connection between said second semiconductor switch and said grounded capacitor defining a voltage output terminal of said voltage booster circuit at which the output voltage equal to twice that of the supply voltage is developed.

4. An electronic timepiece according to claim 1, wherein said voltage booster circuit is comprised of a plurality of capacitors, and a plurality of semiconductor switching elements.

5. An electronic timepiece according to claim 1, wherein said buzzer driving circuit is comprised of: a gate circuit for receiving an oscillatory signal to control the frequency of the oscillatory driving signal generated by said buzzer driving circuit and for receiving the buzzer control signal to generate an output signal when the buzzer is to operate; means for amplifying the gate circuit output signal and for applying the amplified signal to drive said buzzer; and means for inverting and amplifying the gate circuit output signal and for applying the inverted and amplified signal to drive said buzzer.

* * * * *